United States Patent [19]

Fukami

[11] Patent Number: 4,951,210

[45] Date of Patent: Aug. 21, 1990

[54] PROTECTIVE APPARATUS OF VEHICLE MICROCOMPUTER

[75] Inventor: Masanobu Fukami, Hazu, Japan

[73] Assignee: Aisin Seiki Kabushiki Kaisha, Japan

[21] Appl. No.: 238,215

[22] Filed: Aug. 30, 1988

[30] Foreign Application Priority Data

Aug. 31, 1987 [JP] Japan ..... 62-218514

[51] Int. Cl.[5] ..... F02D 11/00

[52] U.S. Cl. ..... 364/431.11

[58] Field of Search ..... 364/431.11, 184, 187, 364/183; 123/416, 417, 479

[56] References Cited

U.S. PATENT DOCUMENTS

| | | | |
|---|---|---|---|
| 4,310,889 | 1/1982 | Imai et al. | 123/479 |
| 4,370,962 | 2/1983 | Hosaka | 123/479 |
| 4,386,427 | 5/1983 | Hosaka | 364/431.11 |
| 4,410,938 | 10/1983 | Higashiyama | 364/431.11 |
| 4,541,050 | 9/1985 | Honda et al. | 364/431.11 |
| 4,577,605 | 3/1986 | Arnold et al. | 364/431.11 |
| 4,580,220 | 4/1986 | Braun et al. | 364/431.11 |
| 4,584,645 | 4/1986 | Kosak | 364/431.11 |
| 4,587,939 | 5/1986 | Hemminger et al. | 364/431.11 |
| 4,611,271 | 9/1986 | Hattori et al. | 364/184 |

*Primary Examiner*—Allen MacDonald

*Attorney, Agent, or Firm*—Finnegan, Henderson, Farabow, Garrett & Dunner

[57] ABSTRACT

Protective apparatus, for a vehicle microcomputer, that constrains the microcomputer output during periods of abnormal microcomputer operation. The protective apparatus includes a regulator connected to receive a microcomputer oscillating signal having a predetermined period during normal operation, the regulator inverting a reset signal provided thereby upon the oscillating signal period exceeding the predetermined period to indicate abnormal operation. The apparatus further includes a one-shot multivibrator (OMB) which inverts its output upon the regulator reset signal being inverted and an output inhibiting logic circuit which receives the microcomputer CPU output, the output inhibiting logic circuit interrupting the microcomputer CPU output when the OMB inverts its output.

7 Claims, 3 Drawing Sheets

PROTECTIVE APPARATUS OF VEHICLE MICROCOMPUTER

BACKGROUND OF THE INVENTION

The present invention relates to protective apparatus of a vehicle microcomputer and, more particularly, to protective apparatus for preventing an abnormal vehicle control operation by the microcomputer.

Japanese Patent Publication No. 62-12536 discloses a known technique for protective apparatus of a microcomputer. The apparatus disclosed in that Japanese Patent Publication uses an output signal of a watch dog circuit as a reset signal for a computer. The level of the output signal from the watch dog circuit is inverted when an input signal pulse is not detected for a time interval that exceeds a predetermined time interval. Apparatus for overcoming a hardware abnormality of the computer system comprises circuit means for inhibiting the computer from accessing a memory and for outputting a signal which indicates a hardware abnormality when the output signal is repeated a predetermined number of times. The protective measure against program malfunction is accomplished by using the hardware abnormality indicating signal.

Accordingly, when program malfunction occurs, a reset pulse is supplied to the computer. In addition, the number of successively generated reset pulses is counted. When the counted number exceeds a predetermined number of reset pulses, it is determined that a hardware abnormality has occurred. When such a determination is made, access to the memory is inhibited in order to protect data, while an indicating unit indicates the abnormality to an operator. As a result of these operations, memory destruction due to hardware abnormalities can be minimized.

In accordance with the above described hardware abnormality protective apparatus of the computer system, a predetermined number of computer reset signals, which are output signals from the watch dog circuit, must be counted. However, before the predetermined number of signals from the watch dog circuit are counted, the processing results of signals output from the computer system are indeterminate. As a result, a device driven by the computer system may be abnormally operated while the output signals from the watch dog circuit are being counted.

For example, assuming that a microcomputer comprising a vehicle electric power steering system causes such an abnormal operation, an output not desired by the vehicle driver may be generated.

SUMMARY OF THE INVENTION

The present invention overcomes the problems and disadvantages of the prior art and has as an object to provide protective apparatus of a vehicle microcomputer, the protective apparatus preventing an abnormal operation by controlling an output from the microcomputer when the microcomputer malfunctions.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, protective apparatus of a vehicle microcomputer according to the present invention comprises a regulator for receiving an oscillating signal output from the vehicle microcomputer and for inverting its reset signal output when an interpulse period of the oscillating signal becomes longer than a predetermined period; a monostable circuit which is triggered upon inversion of the reset signal from the regulator, the monostable circuit being kept in a metastable state for a predetermined period of time; and an output inhibiting logic circuit for constraining a control output from the microcomputer in a predetermined output state in response to an output signal from the monostable circuit in the metastable state.

According to the present invention, when the period of the oscillating signal from the microcomputer, which is supplied to the regulator, becomes longer than a maximum period, and the oscillating signal is not received before the output from the regulator is inverted, it is determined that the microcomputer is in an abnormal operating state and the reset signal output from the regulator is inverted. As a result, the microcomputer is initialized and execution of the program then running is stopped.

In addition, the monostable circuit is triggered by inversion of the reset signal. The output from the monostable circuit is then kept in the metastable state for the predetermined period of time. The output inhibiting logic circuit interrupts the control output from the microcomputer when the monostable circuit is in the metastable state, thereby constraining the microcomputer output.

The accompanying drawings, which are incorporated in and constitute a part of this specification, illustrate one embodiment of the invention and, together with the description, serve to explain the principles of the invention.

Description of the Preferred Embodiment

Figure 1:
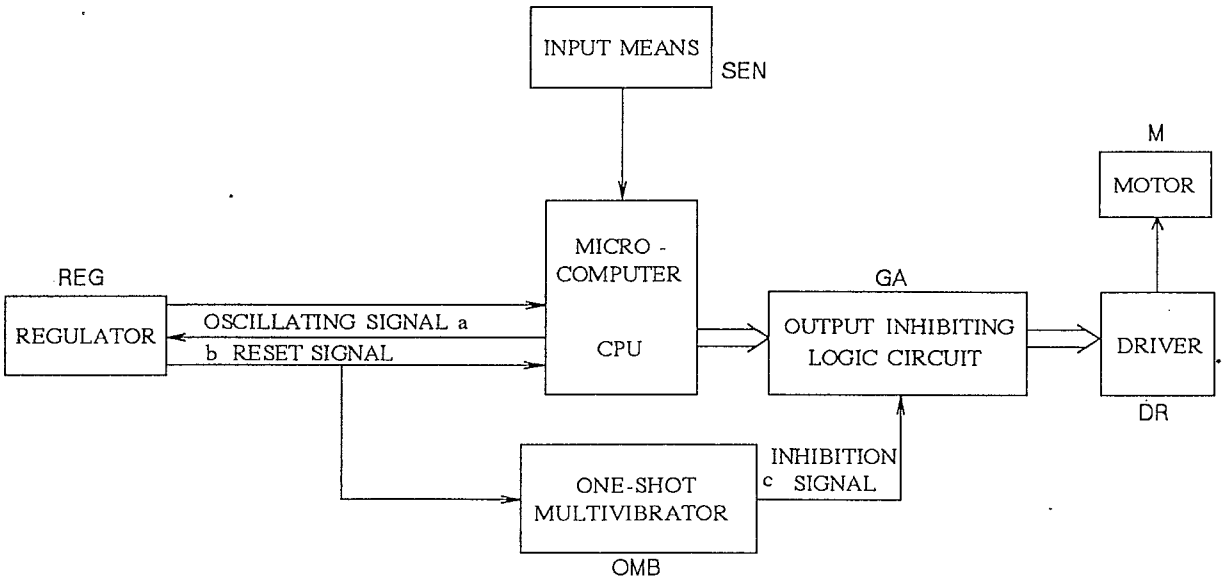
FIG. 1 a block diagram showing a protective apparatus of a vehicle microcomputer according to an embodiment of the present invention.
Figure 2:
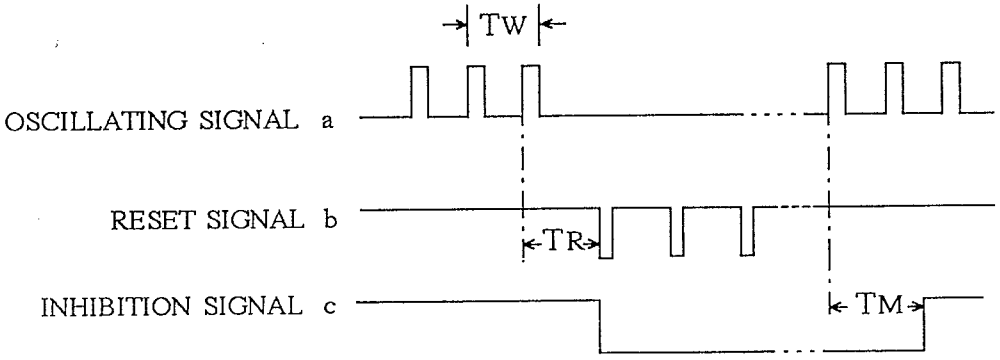
FIG. 2 is a timing chart for explaining an operation of the protective apparatus of the vehicle microcomputer according to the embodiment of the present invention.

Reference will now be made in detail to the present embodiment of the invention, an example of which is illustrated in the accompanying drawings in which FIG. 1 is a block diagram showing protective apparatus of a vehicle microcomputer according to an embodiment of the present invention and FIG. 2 is a timing chart for explaining the operation of the protective apparatus of the vehicle microcomputer according to the embodiment.

Referring to FIGS. 1 and 2, a microcomputer CPU comprises a one-chip microcomputer. An oscillating signal is generated on an output terminal of the microcomputer CPU. A reset signal is supplied to the microcomputer CPU. When the reset signal is inverted from an "L" level to an "H" level, the microcomputer CPU is initialized.

A regulator REG is a circuit that performs a watch dog function and supplies power to the microcomputer CPU. When the microcomputer CPU is in a normal operating state, the regulator REG receives an oscillating signal from the microcomputer CPU and is always set to a reset state. When the oscillating signal is not received, it is determined that the microcomputer CPU is in an abnormal operating state. More specifically, a maximum time period TW of the oscillating signal is a criterion for determining that the microcomputer CPU is in an abnormal operating state. When the oscillating signal is not received for the maximum time period TW and the time interval TR has passed, the regulator REG forcibly inverts the reset signal from the "H" level to the "L" level.

When an input signal to a one-shot multivibrator OMB is inverted from the "H" level to the "L" level, the output from the one-shot multivibrator OMB is set at the "L" level, i.e., in a metastable state, for a predetermined time interval TM, and then is inverted to the "H" level, i.e., to a stable state.

When the output from the one-shot multivibrator OMB is at the "L" level, an output inhibiting logic circuit GA sets its output at the "L" level regardless of the output provided by the microcomputer CPU. An AND gate or the like can be used as the output inhibiting logic circuit GA. It is noted, however, that depending on the output from the microcomputer CPU, apparatus to be controlled by the microcomputer may reside in a stable state upon receipt of an "H" level output. For this reason, the selection of an "H" or "L" level output from the output inhibiting logic circuit GA must be determined in accordance with the operating characteristics of the apparatus being controlled.

An input means SEN is connected to various input switches and sensors. A driver DR is a circuit for driving a motor M. When an input signal is at the "H" level, the driver DR sets its output in an ON state and thereby causes rotation of the motor M.

Since the functions of the microcomputer CPU, the regulator REG, the one-shot multivibrator OMB, the output inhibiting logic circuit GA, the driver DR, the motor M, and the input means SEN as individual elements should, in view of the description provided thus far, be sufficient to enable an understanding of the present invention, a further detailed description of each of these elements will be omitted.

Operation of the protective apparatus of the vehicle microcomputer arranged in this manner is described next.

During normal operation, since the period of oscillating signal a (FIG. 2) supplied from the microcomputer CPU to the regulator REG is shorter than the maximum period TW, a reset signal from the regulator REG is maintained at the "H" level. As a result, the microcomputer CPU is not initialized and continues predetermined program processing. With the regulator REG reset signal maintained at the "H" level, the input to the one-shot multivibrator OMB is maintained at the "H" level and its output, i.e., an inhibition signal c (FIG. 2), is set at a stable state, i.e., at the "H" level. As a result, the input to the output inhibiting logic circuit GA is set at the "H" level. Therefore, an output control signal from the microcomputer CPU is supplied to the driver DR without being constrained by the logic circuit GA, and the control signal output in accordance with a program of the microcomputer CPU is effective to perform predetermined control.

During abnormal operation, however, the period of the oscillating signal a supplied from the microcomputer CPU to the regulator REG becomes longer than the maximum period TW, and the oscillating signal is not received within the time interval TR, where the regulator REG forcibly inverts the reset signal from the "H" level to the "L" level after the time interval TR has passed. It is therefore determined that the microcomputer CPU is in an abnormal operating state, and the reset signal b from the regulator REG is inverted from the "H" level to the "L" level. As a result, the microcomputer CPU is initialized and execution of the predetermined program is stopped. Upon reset processing, the program is checked again. In this case, the input to the one-shot multivibrator OMB is inverted from the "H" level to the "L" level, and the inhibition signal c is inverted from the "H" level to the "L" level for the predetermined period of time TM. This results in the input to the output inhibiting logic circuit GA being set at the "L" level, so that the control signal output from the microcomputer CPU is interrupted, and driving of the motor M is stopped by interruption of the input to the driver DR. If the predetermined time interval TM, i.e., the metastable time interval TM, of the one-shot multivibrator OMB is set to be longer than the time interval TR required for inverting the reset signal output of the regulator REG from the "H" level to the "L" level, these conditions will be maintained until a return to the normal operating state. A return to the normal operating state will occur when the period of the oscillating signal a supplied from the microcomputer CPU to the regulator REG becomes shorter than the maximum period TW.

Figure 3:
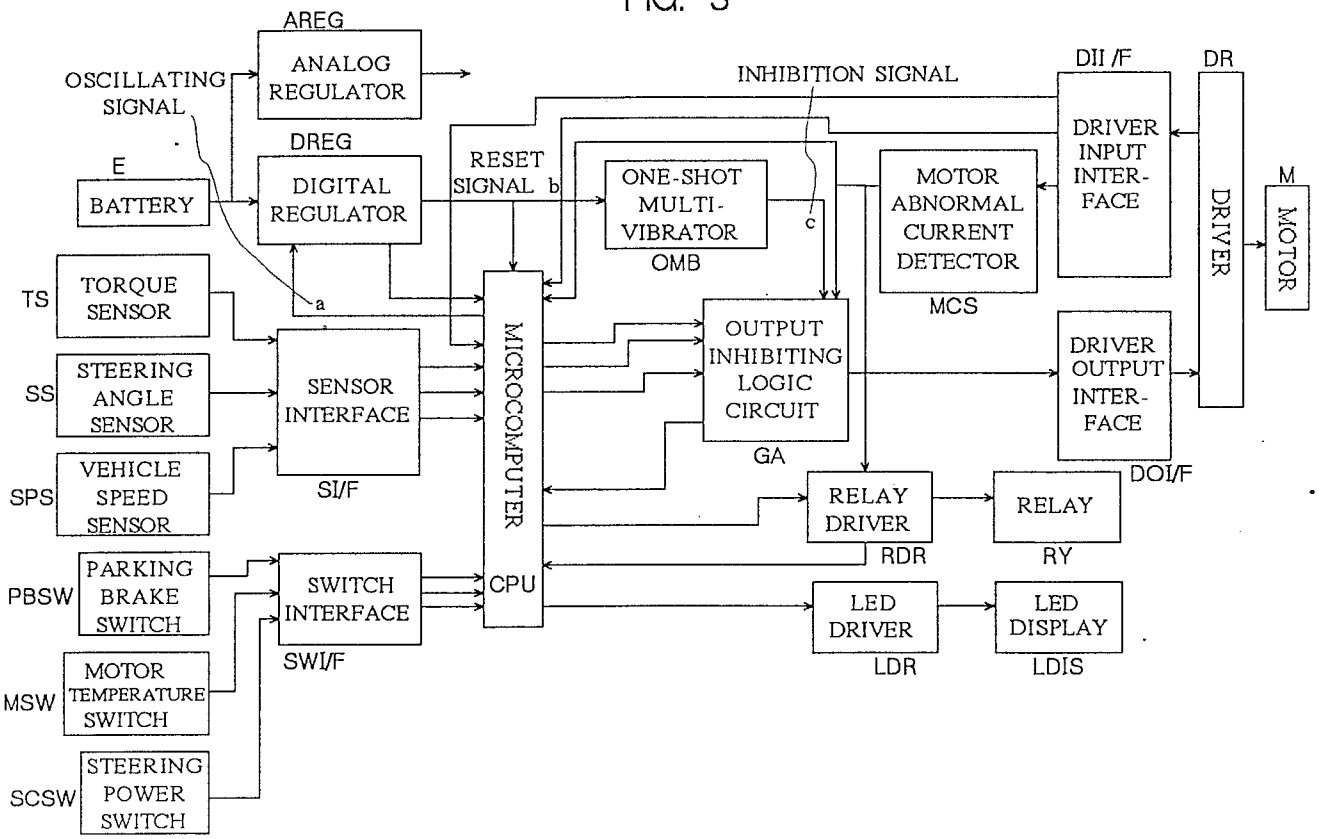
FIG. 3 is a block diagram illustrating application of the protective apparatus of the vehicle microcomputer, according to the embodiment of the present invention, to an electric power steering system.

FIG. 3 is a block diagram showing application of the protective apparatus of the vehicle microcomputer of the above embodiment in an electric power steering system.

An MCS 8397 microcomputer supplied by Intel Corp. is used as a microcomputer for programmably controlling the electric power steering system. The regulator REG shown in FIG. 1 comprises, in FIG. 3, an analog regulator AREG, having a constant voltage circuit, that derives power from a battery E and provides an analog constant voltage output. The regulator REG further comprises a digital regulator DREG. The digital regulator DREG inverts its output to the "H" level when the period of the oscillating signal a becomes shorter than the maximum period TW. The digital regulator DREG further determines that the microcomputer CPU is in an abnormal operating state when the oscillating signal a is not received within the time interval TR and inverts the reset signal b from the "H" level to the "L" level. The digital regulator DREG additionally outputs a battery voltage monitor signal which is set at the "L" level when the voltage of the battery E drops below a predetermined voltage.

When the reset signal b is inverted from the "H" level to the "L" level, a one-shot multivibrator OMB sets its inhibition signal c in the metastable state, i.e., at the "L" level, for the time interval TM, and then inverts the inhibition signal c to a stable state, i.e., the "H" level.

An output inhibiting logic circuit GA receives from the microcomputer CPU right and left signals respectively corresponding to the rotational directions of a motor M. The circuit GA also receives a PWM signal for rotating the motor M by a pulse width modulated signal in accordance with an input to a torque sensor. The circuit GA further sends back an input signal to the microcomputer. When the output from the one-shot multivibrator OMB is set at the "H" level and the output from a motor abnormal current detector MCS is set at the "H" level, the output inhibiting logic circuit GA enables its gate, and outputs the output signals from the microcomputer CPU. When the inhibition signal c from the one-shot multivibrator OMB is set at the "L" level or the output from the motor abnormal current detector MCS is set at the "L" level, the output inhibiting logic circuit GA disables its gate and sets its output at the "L" level.

The output from the output inhibiting logic circuit GA drives the motor M through a driver output interface DOI/F and a driver DR. A signal representing the magnitude of the drive current of the motor M is supplied to the motor abnormal current detector MCS via a driver input interface DII/F, and is monitored by detector MCS. At the same time, a signal representing the flow direction of the motor M drive current, and hence the rotational direction of the motor, is supplied to the microcomputer CPU through the driver input interface DII/F.

A relay driver RDR for operating a relay RY for connecting a power source to the motor M is controlled in response to the PWM signal from the microcomputer CPU. In addition, operation of the relay driver RDR is monitored by the microcomputer CPU. An output from the motor abnormal current detector MCS is coupled to the relay driver RDR. When the output from the motor abnormal current detector MCS is set to an abnormal state, i.e., at the "L" level, the relay RY is operated to disconnect the power source from the motor M.

Still referring to FIG. 3, a torque sensor TS, corresponding to the input means SEN in FIG. 1, detects a torque applied to a steering wheel. A steering angle sensor SS detects a current steering angle of the steering wheel. A vehicle speed sensor SPS detects vehicle speed which is used for changing a torque applied to the steering wheel. Outputs from the torque sensor TS, the steering angle sensor SS, and the vehicle speed sensor SPS are supplied to the microcomputer CPU through a sensor interface SI/F. Outputs from a steering power switch SCSW for electrically changing the value of a torque for pivoting the steering wheel, a parking brake switch PBSW, and a temperature switch MSW of the motor M are supplied to the microcomputer CPU through a switch interface SWI/F.

In addition, an LED driver LDR monitors a control status and provides a display on an LED display LDIS.

Since implementation of a vehicle microcomputer in an electric power steering system for control of electric power steering operation is known, and the details thereof are not directly related to the present invention, a description thereof will be omitted. While operation of the vehicle microcomputer protective apparatus in FIG. 3 is similar to operation of the circuit in FIG. 1, a brief description thereof will nevertheless be provided.

During normal operation, since the period of the oscillating signal a supplied from the microcomputer CPU to the digital regulator DREG is shorter than the maximum period TW, the reset signal b from the digital regulator DREG is kept at the "H" level. In this case, the microcomputer CPU continues predetermined program processing. Since the input to and the inhibition signal c from the one-shot multivibrator OMB are both set at the "H" level, a control signal output from the microcomputer CPU is supplied to the driver DR through the driver output interface DOI/F, thereby enabling control in accordance with a program of the microcomputer CPU.

During abnormal operation, the period of the oscillating signal a supplied from the microcomputer CPU to the digital regulator DREG becomes longer than the maximum period TW, and the oscillating signal a is not received within the time interval TR, where the regulator REG inverts the reset signal b from the "H" level to the "L" level after the time interval TR has passed. In such a case, it is determined that the microcomputer CpU is in the abnormal operating state, and the reset signal b from the regulator DREG is inverted from the "H" level to the "L" level. As a result, the microcomputer CPU is initialized and execution of the predetermined program is stopped. At this time, the input to the one-shot multivibrator OMB is inverted from the "H" level to the "L" level and its inhibition signal c is inverted from the "H" to the "L" level, for the predetermined time interval TM. As a result, the input to the output inhibiting logic circuit GA is set at the "L" level, output from the microcomputer CPU is interrupted, and the driving of motor M is stopped by input interruption of the driver DR. If the metastable time interval TM of the one-shot multivibrator OMB is set to be longer than the time interval TR required for forcibly inverting the output from the regulator DREG from the "H" level to the "L" level, these conditions will be maintained until a return to the normal operating state. A return to the normal operating state will occur when the period of the oscillating signal a supplied from the microcomputer CPU to the regulator DREG becomes shorter than the maximum period TW. With the interruption of the driver DR during the abnormal operating state, the output from the microcomputer CPU cannot and does not rotate the motor M.

As described above, when the period of the oscillating signal supplied from the microcomputer CPU to the regulator DREG becomes longer than the maximum period because of a hardware abnormality or the like, a motor rotational control output from the microcomputer CPU is interrupted. Since the time required for interrupting the control signal corresponds to the excess of the maximum time period between pulses of the oscillating signal, this time interval has substantially no effect on the operation of the system. Therefore, the steering power of the electric power steering system is not applied in a direction opposite to the desired steering direction of the driver.

As described above, the vehicle microcomputer protective apparatus of the present invention comprises the microcomputer CPU, connected to input and output devices for the vehicle, for controlling output devices in accordance with programs; the regulator REG (digital regulator DREG) for receiving an oscillating signal output from the microcomputer CPU and inverting its reset signal output when the period of the oscillating signal becomes longer than a predetermined period; the one-shot multivibrator OMB that is triggered upon inversion of the reset signal from the regulator REG and that keeps a metastable state for a predetermined period of time; and the output inhibiting logic circuit GA for constraining the output from the microcomputer CPU in a predetermined output state in response to the output signal from the one-shot multivibrator OMB in the metastable state.

Therefore, when the period of the oscillating signal supplied from the microcomputer CPU to the regulator REG becomes longer than the maximum period, and the oscillating signal is not received within the time required for inverting the output, it is determined that the microcomputer CPU is in an abnormal operating state, and the reset signal of the regulator REG is inverted, thereby initializing the microcomputer CPU for stopping execution of a predetermined program.

In addition, upon inversion of the reset signal, the one-shot multivibrator OMB is triggered and its output is kept in a metastable state for a predetermined period of time. While the one-shot multivibrator OMB is in the metastable state, the output inhibiting logic circuit GA disables and thereby constrains the output from the microcomputer CPU.

The regulator REG or the digital regulator DREG is used as a regulator for receiving the oscillating signal supplied from the microcomputer in the above embodiment, and inverting its reset signal output when the period of the oscillating signal becomes longer than a predetermined period. However, in practicing the present invention, only the function of receiving an oscillating signal output from the microcomputer CPU and inverting a reset signal output when the period of the oscillating signal becomes longer than a predetermined period is required. Therefore, a circuit called an oscillating circuit, a watch dog circuit or a watch dog timer may be used, so long as the circuit performs the above-described function.

Further, since the multivibrator OMB is triggered upon inversion of the reset signal from the regulator REG and is kept in a metastable state for a predetermined period of time, it is preferred to employ a one-shot multivibrator because of its versatility. However, the present invention may be successfully practiced with any monostable circuit that performs a similar function.

Additionally, since the output inhibiting logic circuit GA constrains the output from the microcomputer CPU to a predetermined output state in response to the metastable output signal from the one-shot multivibrator OMB, circuit GA should comprise a logic circuit that sets an output signal in a fail-safe manner. A simple gate or a circuit called an analog gate may be used for obtaining a single type of signal output. Although, in the above embodiment, the motor input is interrupted, the clutch of the output shaft of the motor may instead be released, or the power source may be disconnected from the motor.

As has been described hereinabove, the vehicle microcomputer protective apparatus of the present invention comprises a regulator, connected to input and output devices for the vehicle, for receiving an oscillating signal output from a microcomputer, for controlling output devices in accordance with programs, and inverting its reset signal when the period of the oscillating signal becomes longer than a predetermined period; a one-shot multivibrator which is triggered upon inversion of the reset signal from the regulator and is kept in a metastable state for a predetermined period of time; and an output inhibiting logic circuit for constraining the output from the microcomputer to a predetermined output state in response to the metastable output signal from the one-shot multivibrator. When the period of the oscillating signal supplied from the microcomputer to the regulator becomes longer than the predetermined period, or the oscillating signal is not received, it is determined that the microcomputer is in an abnormal operating state and the reset signal from the regulator is inverted. The one-shot multivibrator is triggered upon inversion of the reset signal and its output is kept in a metastable state for a predetermined period of time. When the one-shot multivibrator is in the metastable state, the output inhibiting logic circuit interrupts the output from the microcomputer and thereby constrains the control signal output from the microcomputer. Therefore, the present invention can enable proper control in systems where fail-safe operation of a vehicle or the like is required. It is intended that the present invention cover the modifications and variations of this invention provided they come within the scope of the appended claims and their equivalents.

What is claimed is:

1. Protective apparatus of a vehicle microcomputer, comprising:

a microcomputer, connected to vehicle input and output devices, for controlling output devices in accordance with a program;

a regulator for receiving an oscillating signal output from said microcomputer, said regulator inverting a reset signal therefrom when a period of the oscillating signal becomes longer than a predetermined period;

a monostable circuit triggered to a metastable state upon inversion of the reset signal from said regulator, said monostable circuit being kept in the metastable state for a predetermined period of time; and an output inhibiting logic circuit for constraining output from said microcomputer to a predetermined output state in response to an output signal from said monostable circuit in the metastable state.

2. The protective apparatus of claim 1 wherein said monostable circuit comprises a one-shot multivibrator.

3. The protective apparatus of claim 1 wherein said output inhibiting logic circuit comprises an AND gate.

4. The protective apparatus of claim 1 wherein said regulator comprises a digital regulator.

5. Protective apparatus of a vehicle microcomputer, comprising:

a microcomputer, coupled to vehicle input and output devices, for controlling output devices in accordance with a program, said microcomputer providing an oscillating signal, a period of said oscillating signal becoming longer than a predetermined period during abnormal operation of said microcomputer;

a regulator coupled to receive said oscillating signal, said regulator inverting a reset signal provided thereby from an "H" level to an "L" level when the period of said oscillating signal becomes longer than the predetermined period;

a monostable circuit coupled to receive said reset signal, said monostable circuit setting an output thereof at the "L" level when said reset signal is inverted from the "H" level to the "L" level; and an output inhibiting circuit coupled to receive the output of said monostable circuit and an output control signal from said microcomputer, said output inhibiting circuit constraining the output control signal from said microcomputer to the "L" level in response to the monostable circuit output signal being at the "L" level.

6. Apparatus for preventing an abnormal control operation operation by a vehicle microcomputer, comprising:

a microcomputer coupled to a vehicle input device for generating output control signals to control vehicle output devices in accordance with a program;

said microcomputer generating an oscillating signal having a period less than a maximum period during normal operation of said microcomputer;

a regulator for receiving the oscillating signal from said microcomputer and generating a reset signal applied to said microcomputer, said regulator being operative to invert the reset signal when the period of the oscillating signal exceeds the maximum period;

a monostable circuit responsive to the inversion of the reset signal for triggering the monostable circuit to a metastable state for a predetermined time period; and an output inhibiting logic circuit for constraining output control signals from said microcomputer in response to the triggering of said monostable circuit.

7. Apparatus for preventing an abnormal control operation by a vehicle microcomputer, comprising:

a microcomputer coupled to a vehicle input device for generating output control signals to control vehicle output devices in accordance with a program;

said microcomputer generating an oscillating signal having a period less than a maximum period during normal operation of said microcomputer;

a digital regulator for receiving the oscillating signal from said microcomputer and generating a reset signal applied to said microcomputer, said regulator being operative to invert the reset signal when the period of the oscillating signal exceeds the maximum period;

a one-shot multivibrator circuit responsive to the inversion of the reset signal for triggering said one-shot multivibrator to a metastable state for a predetermined time period; and an output inhibiting logic circuit for constraining output control signals from said microcomputer in response to the triggering of said one-shot multivibrator.

* * * * *